United States Patent [19]

Rauch

[11] 4,309,464

[45] Jan. 5, 1982

[54] PERSONALIZED DECORATIVE ORNAMENT

[76] Inventor: Marshall A. Rauch, 1121 Scotch Dr., Gastonia, N.C. 28052

[21] Appl. No.: 195,317

[22] Filed: Oct. 8, 1980

[51] Int. Cl.[3] ..... A47G 33/08

[52] U.S. Cl. ..... 428/11; 428/32

[58] Field of Search ..... 428/4, 5, 11, 32

[56] References Cited

U.S. PATENT DOCUMENTS

| | | | |
|---|---|---|---|
| 2,366,244 | 1/1945 | Ellerstein | 428/5 X |
| 3,132,988 | 5/1964 | Fowler | 428/11 |
| 3,533,890 | 10/1970 | Nesbit | 428/11 |
| 3,586,897 | 6/1971 | Baird | 428/141 X |
| 3,749,629 | 7/1973 | Andrews et al. | 428/90 X |
| 3,829,348 | 8/1974 | Spiegel et al. | 428/11 |
| 4,173,667 | 11/1979 | Rusch | 428/11 |
| 4,196,238 | 4/1980 | Wiggins | 428/11 |

*Primary Examiner*—Henry F. Epstein

*Attorney, Agent, or Firm*—Bell, Seltzer, Park et al.

[57] ABSTRACT

A personalized decorative ornament is provided which includes high sheen strand material spirally wound in individual side-by-side windings about the smooth exterior surface of a three dimensional core, a barrier coating covering the windings of strand material and the exterior surface of the core, a sheet of flexible, conformable material adhesively secured to said barrier coating and bearing thereon decorative ornamentation having a personal significance to the user, and an outer coating of transparent material providing a protective covering for the decorative ornamentation and barrier coating to anchor the windings in place and protect them from abrasion, fraying and displacement and to protect the decorative ornamentation from damage during handling and use.

8 Claims, 4 Drawing Figures

PERSONALIZED DECORATIVE ORNAMENT

This invention relates to decorative ornaments and more particularly to decorative ornaments of the type having a wound strand covering thereon.

Decorative ornaments of the type having a three-dimensional core, usually of molded polystyrene material, with a smooth exterior surface covered by high sheen strand material spirally wound about the core are known and provide exceptional decorative quality and many advantages over prior ornaments, particularly of the decorated glass type. Ornaments of this wound strand covered type are disclosed and claimed in U.S. Pat. No. 3,132,988 issued to Wade F. Fowler on May 12, 1964.

While the advantages of such strand covered ornaments far exceed the deficiencies therein, some such deficiencies have been encountered and have contributed to an effective life that is, at times, shorter than is desired. Such deficiencies include a tendency for the individual windings of strand material to become frayed or abraided due to handling and use, and for the individual windings of strand material to shift relative to the smooth surface of the core thereby becoming loosened. Such loosening or fraying of the strand material greatly decreases the decorative quality of the ornament and may even destroy its usefulness completely. In addition, while numerous designs employing solid color and multi-colored strand material have been used, the designs which are available using such strand material as the sole basis of decorative ornamentation are quite limited.

As means of providing additional decorative quality to the ornaments of this type and also as a means of stabilizing a substantial number of the individual windings of strand material, it has heretofore been proposed to provide an improved decorative ornament including at least one printed design on the wound strand covering of the ornament with the design spanning a substantial number of the individual strand windings and stabilizng those windings on the core. Such an improved decorative ornament is the subject matter of U.S. Pat. No. 4,196,238, issued Apr. 1, 1980 to Anne L. Wiggins. While such printed designs provide a substantially greater range of decorative quality and designs, such designs are limited to more or less general designs having little or no personal significance to individual users. In addition, while the printed designs stabilize those windings which are spanned thereby, usually the designs do not cover the entirety of the wound strand covering of the ornament and therefore does not protect the entire ornament.

With the foregoing in mind, it is the object of the present invention to provide a decorative ornament which provides a substantially increased effective life over previously known ornaments of the wound strand covered type and also provides decorative ornamentation having personal significance to the user of the ornament.

The foregoing object of this invention is accomplished by providing a conformable sheet bearing decorative ornamentation having personal significance to the user of the ornament and adhesively securing this sheet on to the surface of the strand wound covering on the three-dimensional core. There is then provided an outer coating of transparent material over the entirety of the strand wound ornament and sheet of decorative ornamentation. Thus, there is provided a decorative ornament of the strand wound type which has a protective covering over the entirety of the strand wound covering thereon to protect the strand material from abrasion and to permanently hold the individual windings in position.

Additional objects and features of this invention will become apparent from the following detailed description and examples of illustrative embodiments of the invention, and from the accompanying drawings, in which FIG. 1 is a block diagram illustrating certain of the method steps utilized in forming the decorative ornament of the present invention;

Figure 1:
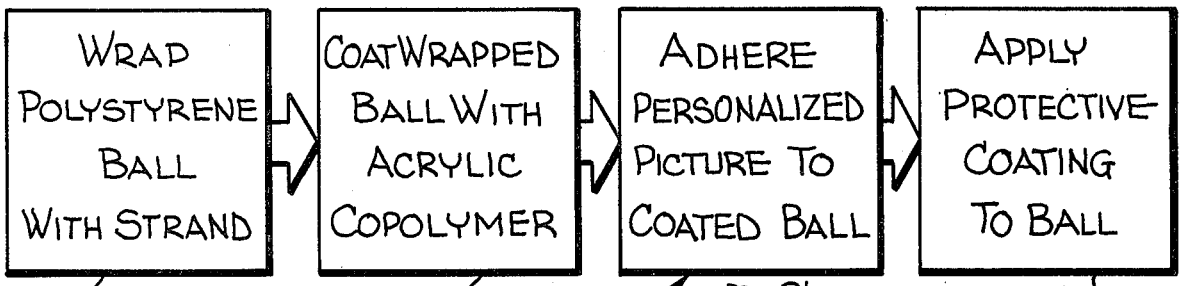
Figure 3:
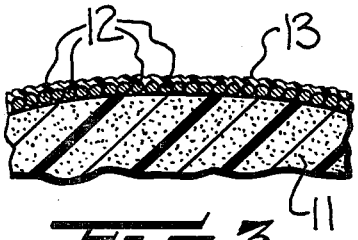
FIG. 3 is an enlarged fragmentary sectional view taken substantially along line 3—3 in FIG. 2.

Referring now more specifically to the drawings, a decorative ornament incorporating the features of the present invention is generally indicated at 10 and includes a core 11 (FIG. 3) having a relatively smooth exterior surface. The core 11 may be of any suitable material but preferably is of light weight plastic, such as molded polystyrene. Additionally, the core 11 may be of any desired shape that is capable of having strand material wound therearound.

The core 11 has an outer covering 12 of strand material, such as rayon acetate yarn or textured polyester yarn, spirally wound about the smooth exterior surface of core 11 in individual windings disposed in side-by-side relationship. Reference is made to U.S. Pat. No. 3,132,988 for a more detailed showing and description of ornaments of this strand wound type and of the manner of forming such ornaments. Insofar as such is needed for a more complete understanding of the present invention, the disclosure of said U.S. Pat. No. 3,132,988 is incorporated herein by reference.

Ornament 10 further includes a barrier coating 13 covering the windings of strand material 12 and the exterior surface of core 11 to protect the core 11 and strand material 12 from chemically reactive materials to be applied subsequently in forming ornament 10 and to form a relatively smooth outer surface to receive decorative ornamentation. The barrier coating 13 consists of a transparent material which is chemically non-reactive with the material from which the core 11 is formed and is also chemically non-reactive with the strand material 12. Preferably, the barrier coating is formed by a clear, non-yellowing, non-toxic, acrylic copolymer which is applied in aqueous solution to the strand wound core so as to completely cover the same. The barrier solution is then dried to form a clear, non-toxic, protective coating for the polystyrene and the strand material. One example of a barrier coating material preferably used with a polystyrene core and either rayon acetate strand material or textured polyester strand material is a water soluble material manufactured and sold by ABCO Chemical Company under the designation ABCO Plastibond LB 24.

To provide additional decorative ornamentation on ornament 10, a sheet of flexible, conformable material 14 is provided with decorative ornamentation 15 which has personal significance to individual users of the ornament 10. Preferably, the decorative ornamentation 15 is in the form of a photograph of a subject which has some particular personal relationship with the individual for whom the ornament 10 is being made and to whom such personalized decorative ornament is intended. In actual practice, photographs or other memorabilia are solicited from individual users or consumers and the ornament is custom formed to include the decorative ornamentation provided by the individual user and is then sold to the user who provided the ornamentation.

The sheet material 14 may be or any suitable character so long as it has sufficient flexibility and conformability to be shaped to the surface of the strand wound base ornament and the barrier coating thereon so as to lie smoothly in contiguous relation thereto without wrinkles or folds therein. A relatively thin, high rag content paper has been found to be preferred for use as the sheet 14 upon which the decorative ornamentation 15 is applied.

The decorative ornamentation 15 may be applied to the sheet 14 in any suitable manner. It is preferred that xerographic reproduction in either black and white or color images be used as a means of applying the decorative ornamentation 15 to the sheet 14.

It is also preferred that a decorative or ornamental border 16 be provided on sheet 14. Such border 16 may be provided on sheet 14 at the same time that decorative ornamentation 15 is provided thereon or may be applied separately, as by an applique which is adhesively secured to the sheet 14 in surrounding relation to the decorative ornamentation 15. Such decorative border 16 may be of any desired character with or without printed indicia therein, but is is preferred that the decorative border 16 include suitable printed indicia 17 particularly selected so as to be in keeping with the theme of the decorative ornamentation 15. For example, printed indicia of "first Christmas 1980" has been used with photographic reproduction of new-born baby, as has other printed indicia indicating "second Christmas", "third Christmas" and so forth. Also, more general themes, such as simply "Merry Christmas 1980", have been used.

Figure 2:
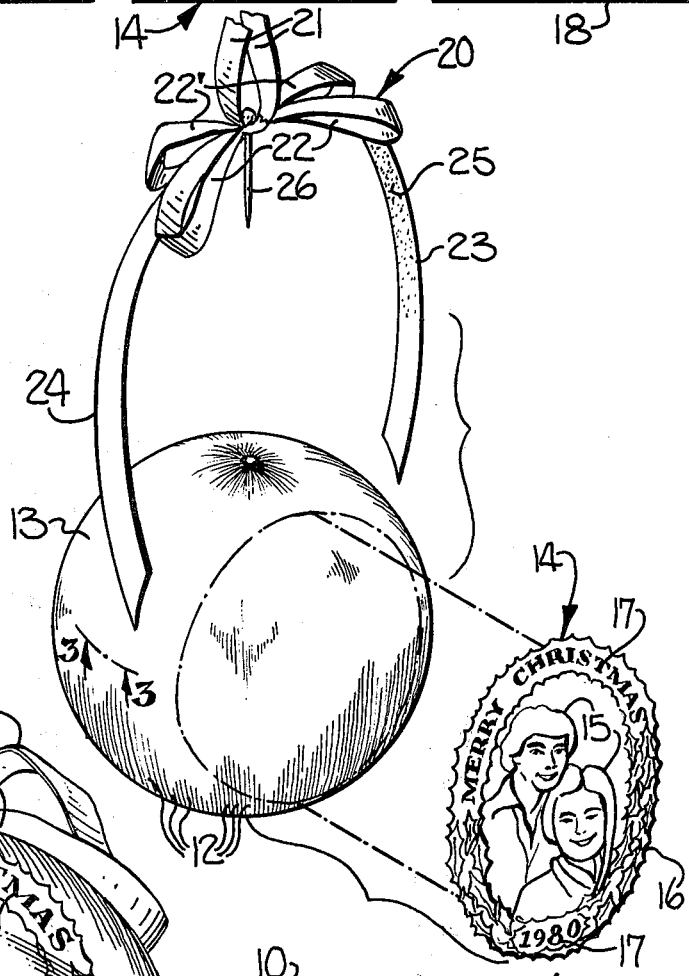
FIG. 2 is an exploded perspective view of the decorative ornament of the present invention.
Figure 4:
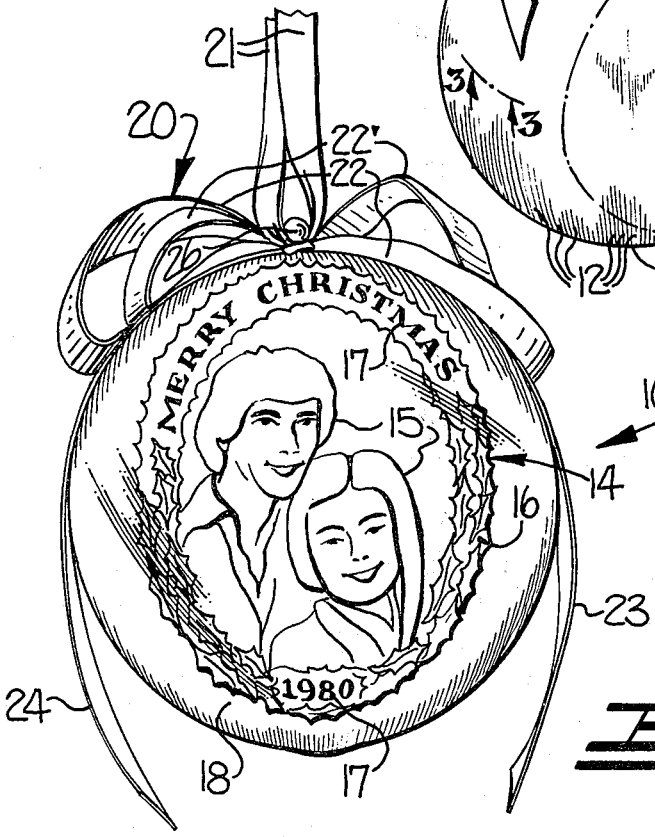
FIG. 4 is an enlarged front elevational view of the completed ornament.

The sheet 14 bearing the decorative ornamentation 15, with or without the decorative border 16, is adhesively secured to the barrier coating 13 and preferably covers a predetermined area thereof. It is noted that the strand wound core has a top and bottom depending upon the direction in which the windings are applied to the core and where the windings cross each other. As shown in FIGS. 2 and 4, it is noted that the windings cross each other at what may be termed the top and bottom of the core 11. Preferably, the sheet 14 is applied to one side of the ornament 10 between the places where the strand windings cross each other.

The adhesive securing sheet 14 to the barrier coating 13 is preferably a heavy bodied, transparent, glossy material which is applied as an aqueous solution to the reverse side of the sheet 14 or to the area of the barrier coating 13 to which the sheet 14 is to be secured. One example of such an adhesive material is sold by Permanent Pigments, Inc. under the designation "Permanent Pigments Liquitex Acrylic Gel Medium Number 5716". This adhesive dries to a clear texture which does not yellow or become brittle and is non-toxic.

Once the sheet 14 bearing the decorative ornamentation 15 and 16 thereon has been adhesively secured to the barrier coating 13, a further protective coating of the adhesive is preferably applied to the exterior surface of the sheet 14 and allowed to dry so as to provide a clear, non-yellowing, protective coating thereon.

An outer coating 18 is applied over the entire outer surface of the ornament to provide a protective covering for the decorative ornamentation 15, 16 and barrier coating 13 and to thereby protect the strand windings 12 from abrasion, fraying and displacement from their side-by-side arrangement and to protect the decorative ornamentation from fading or other deterioration. Preferably, the outer coating 18 is formed by an acrylic lacquer providing a clear, hard, non-brittle, protective layer with a glossy shine. One example of such a material is sold by DuPont De Nemours Company under the designation "DuPont Lucite Acrylic Lacquer 326L Clear". This material is a solvent base material and an example of a solvent therefore is "DuPont Lucite Acrylic Lacquer Thinner 3608S". It is noted that the solvent base for the outer coating 18 would be chemically reactive with the polystyrene core and possibly with the strand material were such not protected by barrier coating 13.

To complete formation of the ornament 10, there is preferably provided a hanger element 20 which is formed of a ribbon-like material and which is secured to the top of the ornament. As illustrated, the hanger element 20 comprises a loop 21 of the ribbon-like material which serves as a means by which the ornament 10 may be hung from any suitable support. Hanger element 20 also includes at least one bow 22 formed of the ribbon-like material which is disposed between the loop 21 and the surface of the ornament. As illustrated, the hanger element 20 includes two such bows 22 and 22'. Finally, the hanger element 21 includes two streamers 23, 24 which extend downwardly on opposite sides of the ornament and serve to frame the decorative ornamentation 15, 16. Hanger element 20 is adhesively secured to the remainder of the ornament 10 by the adhesive used to secure sheet material 14 to the ornament as is indicated by the reference character 25 in FIG. 2. Additionally, a pin 26 passes through hanger element 20 and penetrates into core 11 to serve as a means for holding the various members of hanger element 20 together and to provide an additional securing means for attaching the hanger element to the remainder of the ornament.

In the drawings and specification, there has been shown and described a preferred embodiment of the invention. Although specific terms have been employed, they are used in a generic and descriptive sense only and not for purposes of limitation.

That which is claimed is:

1. A decorative ornament characterized by substantially increased effective life and by decorative ornamentation having personal significance to the user of the ornament, said ornament comprising:

(a) a three-dimensional core having a smooth exterior surface, (b) strand material spirally wound about the smooth exterior surface of said core in individual windings disposed in side-by-side relationhip and providing a smooth outer covering for said core, (c) a barrier coating covering said windings of strand material on said core, said barrier coating consisting of a transparent material which is chemically non-reactive with the material from which said core is formed and with said strand material and forming a sealing layer over said strand material and said core to provide a relatively smooth surface to receive decorative ornamentation thereon, (d) a sheet of flexible, conformable material adhesively secured to said barrier coating and covering a predetermined area thereof, said sheet bearing decorative ornamentation, and (e) an outer coating of a transparent material which provides a protective covering for the decorative ornamentation and barrier coating, whereby the strand windings are protected from abrasion, fraying and displacement from their side-by-side arrangement and an ornament having personalized decorative ornamentation is provided.

2. A decorative ornament according to claim 1 wherein said decorative ornamentation having personal significance comprises a photograph of a subject having personal significance to the user.

3. A decorative ornament according to claim 2 wherein said decorative ornamentation also includes a decorative border around said photograph.

4. A decorative ornament according to any of claims 1–3 wherein said barrier coating comprises a clear, non-yellowing, non-toxic acrylic copolymer.

5. A decorative ornament according to any of claims 1–3 wherein said outer coating comprises an acrylic lacquer providing a clear, hard, non-brittle, protective layer with a glossy shine.

6. A decorative ornament characterized by substantially increased effective life and by decorating ornamentation having personal significance to the user of the ornament, said ornament comprising:

(a) a three-dimensional core of polystyrene material having a smooth exterior surface, (b) strand material spirally wound about the smooth exterior surface of said core in individual windings disposed in side-by-side relationship and providing a smooth outer covering for said core.

(c) a barrier coating covering said windings of strand material on said core, said barrier coating comprising an acrylic copolymer which is chemically non-reactive with the polystyrene material from which said core is formed and with said strand material and forming a clear, non-yellowing sealing layer over said strand material and said core to provide a relatively smooth surface to receive decorative ornamentation thereon, (d) a sheet of flexible, conformable material bearing thereon decorative ornamentation having personal significance to the user of the ornament, (e) a heavy bodied, transparent, glossy acrylic gel adhesive securing said sheet to said barrier coating, and (f) an outer coating of an acrylic lacquer forming a clear, hard, non-brittle, protective covering for the decorative ornamentation and barrier coating, whereby the strand windings are protected from abrasion, fraying and displacement from their side-by-side arrangement and an ornament having personalized decorative ornamentation is provided.

7. A decorative ornament according to claim 6 wherein said decorative ornamentation comprises a photograph of a subject having personal significance to the user and a decorative or ornamental border around said photograph.

8. A decorative ornament according to any of claims 6 and 7 including a hanger element of ribbon material secured to covered core and including a loop of the ribbon material for hanging of the ornament from any suitable support, at least one bow formed of the ribbon material and being disposed between said loop and said outer coating, and a pair of streamers of the ribbon material extending downwardly on opposite sides of said core and serving to frame said decorative ornamentation therebetween.

* * * * *